United States Patent [19]

Bergeron

[11] Patent Number: 4,998,762

[45] Date of Patent: Mar. 12, 1991

[54] POWER BUCKET

[76] Inventor: Raymond E. Bergeron, 3452 W. Jefferson, Trenton, Mich. 48183

[21] Appl. No.: 409,607

[22] Filed: Sep. 18, 1989

Related U.S. Application Data

[63] Continuation-in-part of Ser. No. 341,488, Apr. 20, 1989, abandoned.

[51] Int. Cl.[5] ..... B66C 3/02

[52] U.S. Cl. ..... 294/68.23; 294/11; 37/184

[58] Field of Search ..... 294/68.23, 68.1, 68.2, 294/68.21, 68.22, 111, 112; 37/183 R, 184

[56] References Cited

U.S. PATENT DOCUMENTS

| | | | |
|---|---|---|---|
| 424,571 | 4/1890 | Pay | 294/68.23 X |
| 1,298,340 | 3/1919 | Hatt | 37/184 |
| 4,538,848 | 9/1985 | Aberkrom | 294/68.23 |

FOREIGN PATENT DOCUMENTS

| | | | |
|---|---|---|---|
| 1435528 | 11/1988 | U.S.S.R. | 294/68.23 |

*Primary Examiner*—Margaret A. Focarino
*Assistant Examiner*—Dean J. Kramer
*Attorney, Agent, or Firm*—Gifford, Groh, Sprinkle, Patmore and Anderson

[57] ABSTRACT

A power shovel is disclosed for loading and unloading cargo. The bucket includes a first bucket half and a second bucket half wherein each bucket half has a top, a closed bottom, a front wall and a back wall which are spaced apart from each other, a closed outside wall and an open inside. The bucket halves are pivotally secured together at their tops so that the bucket halves are movable between an open and a closed position. In their closed position, the open inside of the bucket halves register with each other so that cargo is contained within the bucket. A head is disposed above the bucket and is attached to the bucket by four elongated cables. Two cables are attached to the outside corners of one bucket half while, similarly, the other two cables are secured to the outside corners of the other bucket half. One end of a closure cable is secured to a winch so that the cable extends through a swivelable pulley assembly, around pulleys in each bucket half, and then exits through a second swivelable pulley assembly. The other end of the closure cable is attached to the crane or a further winch. Upon activation of the winch, the closure cable moves the bucket from its open to its closed position while the swivelable pulley assemblies prevent galling of the cable by the bucket.

8 Claims, 2 Drawing Sheets

POWER BUCKET

CROSS REFERENCE TO RELATED APPLICATIONS

This application is a continuation-in-part of U.S. Ser. No. 341,488, filed on Apr. 20, 1989 now abandoned, and entitled POWER BUCKET.

BACKGROUND OF THE INVENTION

I. Field of the Invention

The present invention relates to power shovels for loading and unloading cargo.

II. Description of the Prior Art

The previously known clam shell buckets of the type used with power shovels typically comprise a pair of bucket halves which are pivotally secured adjacent their upper end. The upper end of the bucket is also known as the bucket "head" and this head is connected by a cable to a power mechanism which raises and lowers the bucket. Additionally, a closure cable extends through the head and is secured to the bucket halves for moving the bucket halves between their open and closed positions.

A primary disadvantage of these previously known buckets is that the buckets are made of a cast construction. The cast construction is not only expensive to manufacture but also significantly increases the overall weight of the bucket. This, in turn, reduces the overall cargo capacity of the bucket since the capacity of the power shovel is determined not only by the weight of the cargo within the bucket, but also the weight of the bucket itself. For example, if the power winch for raising the bucket is capable of lifting 15 tons and the bucket itself weighs 5 tons, then only 10 tons of cargo can be lifted by the power shovel.

One reason for the excessive weight of these previously known scoops or buckets for power shovels is that the head is cast as a one-piece construction with at least one of the bucket halves so that the extra metal between the head and the bucket half significantly increases the overall weight of the bucket. Additionally, a cast construction is typically relatively thick which also increases the overall weight of the bucket.

A still further disadvantage of these previously known buckets for power shovels is that the volume carrying capability of the shovel remains fixed even though the density or weight per volume of the cargo varies. Consequently, for particularly dense cargo, overloading of the power winch mechanism can occur when the bucket becomes fully loaded.

A still further disadvantage of these previously known clam shell buckets for power shovels is that, due to the weight of the head, the bucket is top heavy when placed in an at rest position on the ground. This in turn can result in capsizing of the clam shell bucket.

A still further disadvantage of these previously known buckets is that the bucket galls the closure cable during closure and lifting of the bucket. This is especially true when the bucket twists about a vertical axis.

SUMMARY OF THE PRESENT INVENTION

The present invention provides a bucket for a power shovel which overcomes all the above mentioned disadvantages of the previously known devices.

In brief, the bucket of the present invention comprises a first bucket half and a second bucket half wherein each bucket half has a top, a closed bottom, spaced apart front and back walls, a closed outside wall and an open inside. The bucket halves are preferably secured at their tops so that the bucket halves are movable between an open and a closed position. In their open position, the open inside of the bucket halves engage the cargo while, in their closed position, the open insides of the bucket halves register with each other so that the cargo is contained within the bucket.

Unlike the previously known buckets for power shovels, however, the head for the bucket of the present invention is not secured directly to one of the bucket halves. Instead, the head of the present invention is disposed above the bucket halves and is secured to the bucket halves by four cables. Two cables extend to the outside corners of one bucket half and, similarly, the other two cables extend to the outside corners of the other bucket half. The cables, which are much lighter than an integral metal construction, effectively decrease the overall weight of the bucket for a given cargo carrying capability.

A closure cable also extends through the head and is secured to both bucket halves. The closure cable, when retracted, causes the bucket halves to move from their open and to their closed position. Conversely, the normal weight of the bucket halves urges the bucket from its closed and towards its open position. Unlike the previously known buckets, the closure cable extends through a first and second swivelable guide pulley assemblies as it enters and exits the bucket, respectively. The guide pulley assemblies protect the bucket from galling from the closure cable despite twisting movement of the bucket.

Moreover, unlike the previously known buckets, the present invention comprises a welded steel construction. Such a construction is much less expensive not only in fabrication costs but is also lighter in overall weight.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
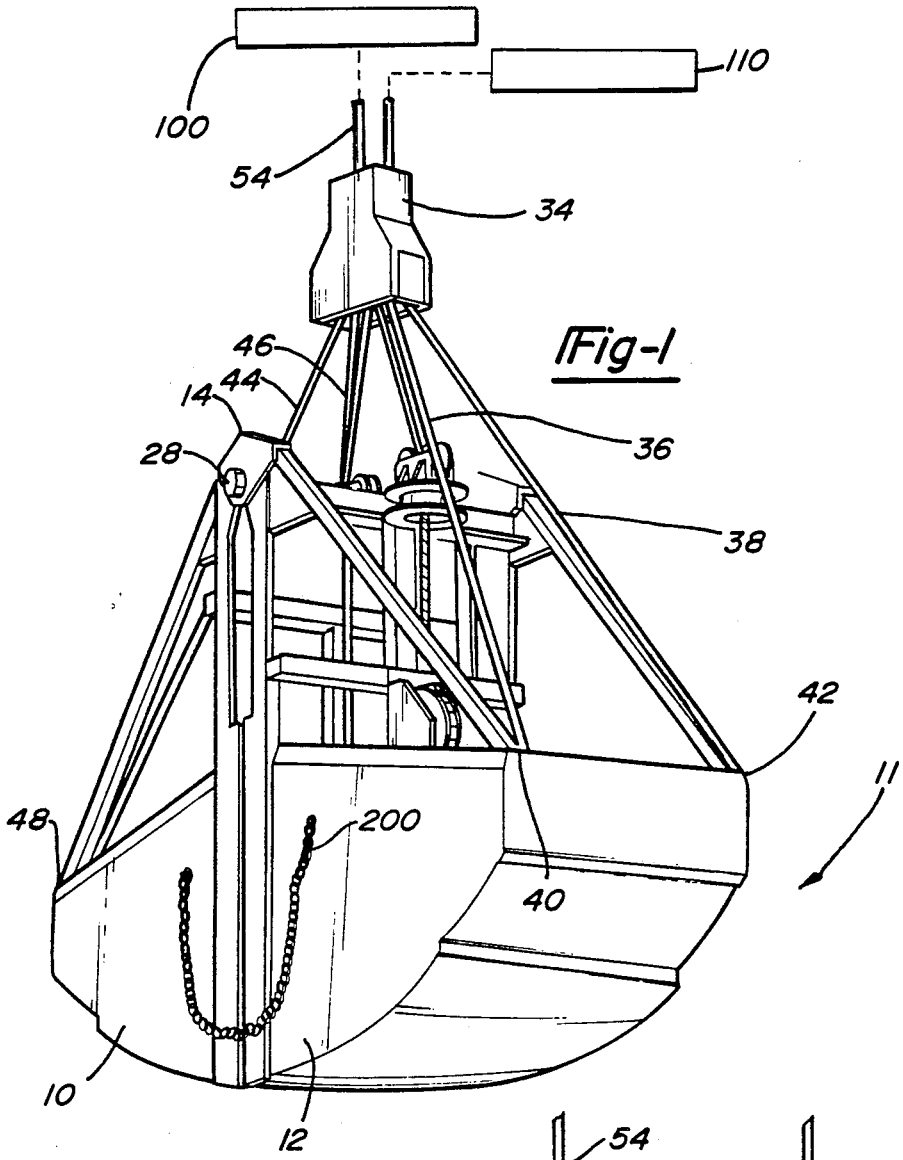
FIG. 1 is a perspective view illustrating the preferred embodiment of the invention.
Figure 2:
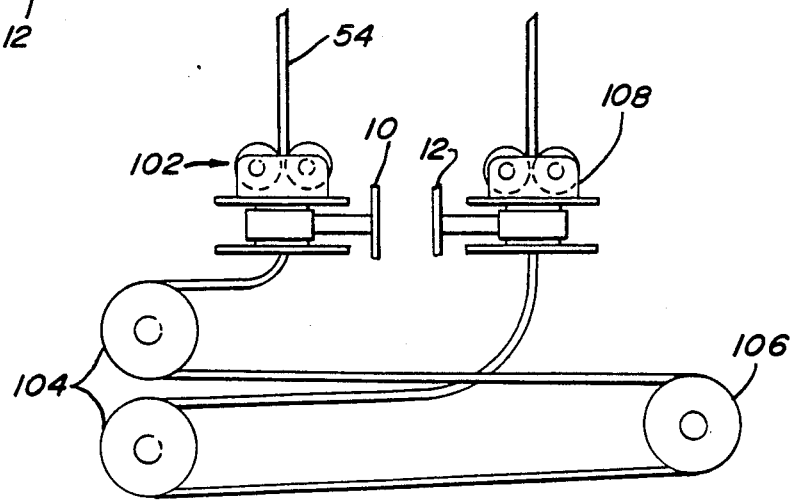
FIG. 2 is a side diagrammatic view illustrating the operation of the closure cable of the present invention.
Figure 3:
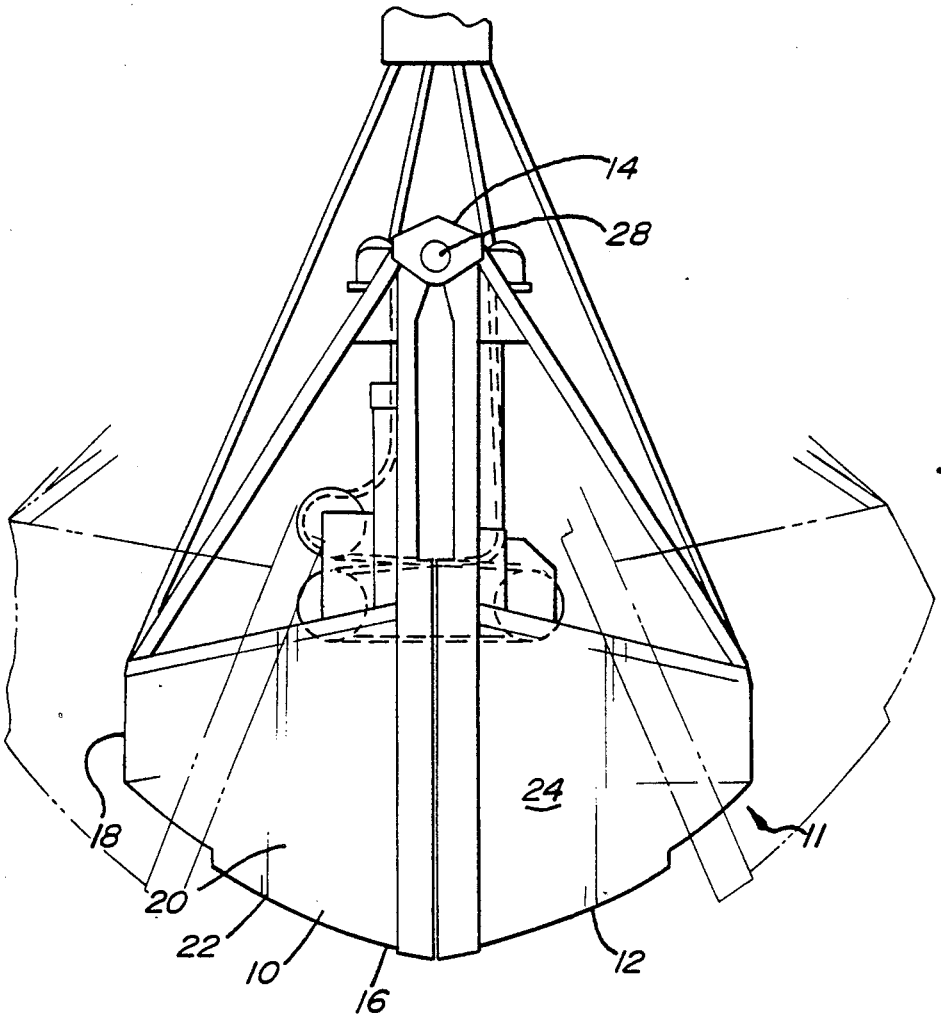
FIG. 3 is an end view of the preferred embodiment of the invention.

With reference first to FIGS. 1–3, a preferred embodiment of the bucket 11 for a power shovel is thereshown and comprises two bucket halves 10 and 12. The bucket halves 10 and 12 are movable between an open position, illustrated in phantom line in FIG. 3, and a closed position, illustrated in solid line in FIG. 3 in a fashion which will be subsequently described in greater detail.

As shown in FIG. 1 and 3, each bucket half 10 or 12 is substantially identical to the other and comprises a top 14, a closed bottom wall 16, a closed outside end wall 18, a front wall 20 and a rear wall 22 The inside 24 of each bucket half 10 and 12, however, is open so that, when the bucket halves 10 and 12 are moved to their closed position, the bucket scoops cargo into the interior of the bucket 11 and the insides 24 of the bucket halves 10 and 12 register with each other.

Referring now to FIGS. 1 and 3, the bucket halves 10 and 12 are pivotally secured together at their top by an elongated cylindrical bearing 28 which extends through registering journals on the bucket halves 10 and 12. Preferably, the cylindrical bearing 28 is tubular in construction thereby minimizing the weight of the bearing connection.

The bucket halves 10 and 12 are constructed of a welded steel construction consisting of plates, supports, etc., which are welded together to form the bucket halves 10 and 12. This construction not only minimizes the cost and weight of the bucket 11 in comparison with the previously known cast constructions, but also reduces the fabrication time necessary to construct the bucket 11.

Referring now particularly to FIG. 1, a head 34 is disposed above the bucket halves 10 and 12 by a distance at least as great as the overall height of the bucket halves 10 and 12. Two cables 36 and 38 are secured to the outside corners 40 and 42 of one bucket half 12 while, similarly, two further cables 44 and 46 are secured to the outside corners 48 (only one shown) of the other bucket half 10. These cables 36, 38, 44 and 46 are preferably constructed of steel and serve to support the bucket halves 10 and 12 from the head 34.

With reference now to FIGS. 1 and 2, a closure cable 54 has one end mechanically connected to a winch 100 and extends through a swivelable guide pulley assembly 102 attached to one bucket half 10. The cable 54 then alternately extends around one or more pulleys 104 on the bucket half 10 and one or more pulleys 106 on the other bucket half 12. The cable 54 then extends out through a second swivelable guide pulley assembly 108 and is then attached to the crane 110 or a second winch.

Figure 4:
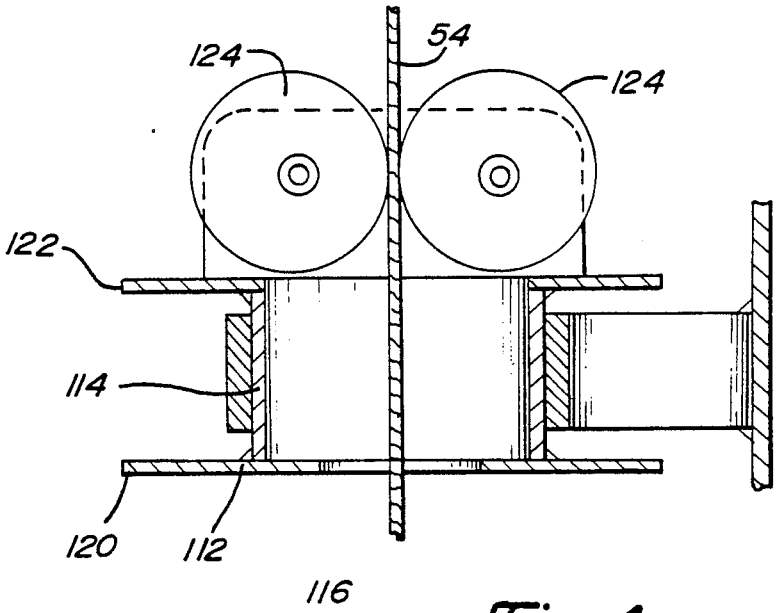
FIG. 4 is a diagrammatic sectional view of a portion of the closure mechanism.

The swivelable guide pulley assemblies 102 and 108 are substantially identical to each other so that only one pulley assembly 102 will be described in detail, it being understood that a like description shall also apply to the other guide pulley assembly 108. With reference then to FIG. 4, the guide pulley assembly 102 includes a housing 112 with a central tubular cylindrical portion 114 which, in turn, is rotatably or swivelably mounted in a tubular cylindrical journal on the bucket half 10. Thus, the housing 112 can rotate or swivel about the axis 116 of the housing portion 114 while flanges 120 and 122 prevent separation of the pulley assembly 102 from the bucket half 10.

A pair of guide pulleys 124 are rotatably mounted to the housing 112 and are arranged so that the closure cable 54 extends between both guide pulleys 124 and also so that the cable 54 extends through the tubular housing portion 114.

In operation, as the cable 54 is raised with respect to the bucket 11, the closure cable 54 forces the bucket halves 10 and 12 from their open and to their closed position thus scooping cargo into the interior of the bucket 10 in the desired fashion. Continued lifting of the cable 54 raises the now closed bucket together with its cargo. Furthermore, the swivelable guide pulley assemblies 102 and 108 eliminate any rubbing between the cable 54 and the bucket 11, despite twisting of the bucket 11 about a vertical axis, thereby eliminating possible galling of the bucket 11 by the cable 54.

One or more cables or chains 200 extend between the bucket halves 10 and 12 and limit the maximum opening of the bucket 11 and also absorbs opening forces.

From the foregoing, it can be seen that the bucket of the present invention achieves several advantages over the previously known buckets for power shovels. One advantage is that, since the head 34 is connected to the bucket halves 10 and 12 by the relatively lightweight cables 36, 38, 44 and 46, the overall weight of the bucket 10 is considerably less than a comparable size bucket of equal volume capability. Consequently, with the same power shovel, greater loads can be carried by the bucket 11 of the present invention.

A still further advantage of the present invention is that, since the cables extending between the head and the bucket halves are connected to the outside corners of the bucket halves, the weight of the bucket halves 10 and 12 urge the bucket 11 to the open position. This minimizes the need for any counterweights of the bucket thereby further reducing the overall weight of the bucket.

A still further advantage of the present invention is its provision for welded steel construction as opposed to the cast construction for the previously known buckets The welded steel construction of the present invention is not only lighter in weight and less expensive in construction than the previously known cast buckets, but may also be constructed more rapidly than the previously known cast buckets.

The present invention is further advantageous in that it enjoys a relatively low center of gravity since the head 34 and cables 36, 38, 44 and 46 are relatively lightweight in construction with respect to the bucket halves 10 and 12. Thus, when the bucket is in an open position and resting on the ground, it will not capsize.

A still further advantage of the present invention is its provision of the swivelable pulley assemblies which protect the cable from damage which might otherwise be caused by a rubbing contact between the cable and bucket.

Having described my invention, however, many modifications thereto will become apparent to those skilled in the art to which it pertains without deviation from the spirit of the invention as defined by the scope of the appended claims.

I claim:

1. A bucket for loading and unloading cargo comprising:

a first bucket half and a second bucket half, each bucket half having a top, a closed bottom, a front wall and a back wall which are spaced apart from each other, a closed outside wall and an open inside end, means for pivotally securing the tops of said bucket halves together so that said bucket halves are movable between an open position and a closed position pivoting about said means, wherein in said closed position said open ends register with each other to contain cargo within an interior of the bucket and wherein in said open position said open ends of said bucket halves are spaced apart to encompass the cargo to be loaded, a head, a first pair of cables, said first pair of cables being secured at one end to said head and being secured at their other ends adjacent the outside wall of one bucket half, a second pair of cables, said second pair of cables being secured at one end to said head and being secured at their other ends adjacent the outside wall of the other bucket half, and means for pivotally moving said bucket halves from said open to said closed position comprising a closure cable extending through said head and through a guide pulley assembly swivelably mounted to at least one bucket half about a vertical axis, said closure cable then being connected within and to each of said bucket halves below said means pivotally securing the tops of said bucket halves together, wherein said closure cable returns through said head.

2. The invention as defined in claim 1 and comprising two guide pulley assemblies, one guide pulley assembly being mounted to each bucket half, and each guide pulley assembly having two guide pulleys with said closure cable extending between said guide pulleys.

3. The invention as defined in claim 1 wherein each bucket half is of a welded steel construction.

4. The invention as defined in claim 1 wherein said pivotal securing means comprises a cylindrical tube extending through registering openings on said bucket halves.

5. The invention as defined in claim 1 wherein said guide pulley assembly comprises two guide pulleys and a housing, said housing having a central tubular cylindrical portion mounted in a tubular cylindrical journal on one bucket half.

6. The invention as defined in claim 5 wherein said guide pulleys are adjacent each other, centered above said tubular housing portion with said closure cable extending between said pulleys and through said tubular housing portion.

7. The invention as defined in claim 1 wherein the connection within and to each of said bucket halves is a pulley around which said closure cable passes for pivotally moving said bucket halves from said open to said closed position.

8. A bucket for loading and unloading cargo comprising:

a first bucket half and a second bucket half, each bucket half having a top, a closed bottom, a front wall and a back wall which are spaced apart from each other, a closed outside wall and an open inside end, means for pivotally securing the tops of said bucket halves together so that said bucket halves are movable between an open position and a closed position pivoting about said means, wherein in said closed position said open ends register with each other to contain cargo within an interior of the bucket and wherein in said open position said open ends of said bucket halves are spaced apart to encompass the cargo to be loaded, a head, a first pair of cables, said first pair of cables being secured at one end to said head and being secured at their other ends adjacent the outside wall of one bucket half, a second pair of cables, said second pair of cables being secured at one end to said head and being secured at their other ends adjacent the outside wall of the other bucket half, and means for pivotally moving said bucket halves from said open to said closed position comprising a closure cable extending through said head and through a guide pulley assembly swivelably mounted to at least one bucket half about a vertical axis, said closure cable then being connected within and to each of said bucket halves below said means pivotally securing the tops of said bucket halves together, wherein the connection within and to each of said bucket halves is a pulley around which said closure cable passes for pivotally moving said bucket halves from said open to said closed position, and wherein said means for pivotally moving said bucket halves from said open to said closed position includes first and second guide pulleys assemblies and first, second and third closure pulleys, said first guide pulley assembly and said first and third closure pulleys being attached to one of said bucket halves and said second guide pulley assembly and said second closure pulley being attached to said other bucket half, and said closure cable passes through said head, through said first guide pulley assembly, around said first closure pulley, around said second closure pulley, around said third closure pulley, through said second guide pulley assembly and through said head.

* * * * *